US008847519B2

(12) United States Patent
Hontele

(10) Patent No.: US 8,847,519 B2
(45) Date of Patent: Sep. 30, 2014

(54) SYSTEM FOR DRIVING A LAMP

(75) Inventor: Bertrand Johan Edward Hontele, Breda (NL)

(73) Assignee: Koninklijke Philips N.V., Eindhoven (NL)

( * ) Notice: Subject to any disclaimer, the term of this patent is extended or adjusted under 35 U.S.C. 154(b) by 174 days.

(21) Appl. No.: 13/264,160

(22) PCT Filed: Apr. 16, 2010

(86) PCT No.: PCT/IB2010/051659

§ 371 (c)(1),
(2), (4) Date: Oct. 13, 2011

(87) PCT Pub. No.: WO2010/122461

PCT Pub. Date: Oct. 28, 2010

(65) Prior Publication Data

US 2012/0032604 A1 Feb. 9, 2012

(30) Foreign Application Priority Data

Apr. 21, 2009 (EP) ..... 09158353

(51) Int. Cl.
*H05B 41/36* (2006.01)
*H05B 33/08* (2006.01)

(52) U.S. Cl.
CPC ..... *H05B 33/0815* (2013.01); *H05B 33/0848* (2013.01)
USPC ..... 315/308; 315/291

(58) Field of Classification Search
USPC ..... 315/224, 246, 247, 250, 291
See application file for complete search history.

(56) References Cited

U.S. PATENT DOCUMENTS 5,565,739 A * 10/1996 Brownell ..... 315/169.3
7,777,422 B2 * 8/2010 Kohno et al. ..... 315/209 R
8,125,806 B2 * 2/2012 Nangreaves et al. ..... 363/95
2001/0024112 A1 9/2001 Jacobs et al.
2004/0183469 A1 9/2004 Lin et al.
2005/0122060 A1 6/2005 Yu et al.
2006/0012314 A1 1/2006 Suzuki
2008/0191642 A1 8/2008 Slot et al.
2009/0015174 A1 * 1/2009 Huang et al. ..... 315/250
2009/0108767 A1 * 4/2009 Kohno et al. ..... 315/291

OTHER PUBLICATIONS

Sauerlaender et al., "Power supply for LED backlight", 2007, pp. 1-13, interesting portions marked.

* cited by examiner

*Primary Examiner* — Douglas W Owens
*Assistant Examiner* — Monica C King
(74) *Attorney, Agent, or Firm* — Yuliya Mathis

(57) ABSTRACT

A driver (10) for driving a LED (2) comprises:

an ACDC converter (5) receiving AC mains voltage and generating DC output current;

a chopper (6) receiving the DC output current and provide a regularly interrupted output current;

a clock generator (20) generating a clock signal ($S_{CL}$);

a controller (50) receiving a user input signal ($S_U$) indicating a dimming level, receiving the clock signal, receiving a mains signal ($S_M$) representing the actual phase of the mains voltage, and generating a control signal ($S_C$) for the chopper.

The chopper is responsive to the controller's control signal as regards the switching moments of the output current.

The controller calculates the required duty cycle on the basis of the user input signal.

The controller synchronizes its control signal with the mains signal.

The controller sets an arbitrary value for the phase difference of the output control signal with respect to the input mains signal.

7 Claims, 2 Drawing Sheets

SYSTEM FOR DRIVING A LAMP

FIELD OF THE INVENTION

The present invention relates in general to a system for driving light sources, particularly solid state light sources such as LEDs, powered from an alternating power source such as mains, capable of dimming the light source. In the following, the light source will simply be indicated as "LED".

BACKGROUND OF THE INVENTION

FIG. 1 schematically illustrates a traditional approach for dimming a light source 2. A variable resistor 3 is connected in series with the light source 2, and this series arrangement is connected to an input 1, which is to be connected to mains, which can be considered to be a source of constant amplitude alternating voltage. As a result, the light source will receive less voltage. Disadvantages of this approach include the dissipation occurring in the resistor, the reduced accuracy of the dimming level at low intensities, and a color shift of the light output due to changing LED current.

FIG. 2 schematically illustrates a different but nevertheless traditional approach for dimming a light source 2. A dimmer 4 receives the AC voltage from mains at its input, and outputs a phase-cut AC voltage, i.e. a voltage that is substantially zero for a range of phases and substantially equal to the input voltage for the remaining phases. A disadvantage of such approach is that it may lead to visible flicker and stroboscopic effects.

FIG. 3 schematically illustrates an approach which avoids the above disadvantages, and which will be indicated as "duty cycle dimming at higher frequency". A converter 5 receives the AC mains voltage, and outputs a DC current. A chopper 6 receives the DC current from the converter 5, and outputs a chopped current having a chopping frequency typically in the range of 300 Hz to 3 kHz, at least higher than the mains frequency. "Chopping" means that in a first portion of the current period (i.e. the inverse of the chopping frequency) the current is zero while in a second portion of the current period the current is equal to the received input current, or vice versa. The ratio of the duration of the second portion to the entire period is indicated as the duty cycle; varying the duty cycle varies the average current.

SUMMARY OF THE INVENTION

The present invention elaborates further on the higher frequency duty cycle dimming as illustrated in FIG. 3. A problem in such approach relates to the fact that the system clock determining the chopping frequency is typically a free running clock while the DC current as output by the converter 5 is not exactly constant but has a small variation correlated to the mains phase. The chopping frequency may vary somewhat in practice, or may be stabilized. If the chopping frequency is not an exact multiple of the mains frequency, a beat effect may occur so that the light output slowly varies at a relatively low frequency, which is perceived as flicker: for instance, if the mains frequency is equal to 50 Hz and the chopping frequency is equal to 310 Hz, a beating frequency of 10 Hz may occur. An object of the present invention is to provide a driver system in which this problem is eliminated or at least reduced.

According to an important aspect of the present invention, the chopping frequency is synchronized to the mains frequency, while the phase of the chopping frequency with respect to the mains frequency is set at random. As a result, if multiple LEDs are driven by multiple drivers having the present invention implemented, all LEDs will be driven at the same frequency but they will have different phases with respect to each other. Due to the synchronization, no beat effects will occur. Due to the different phasing of the chopping frequency, the dark periods of the different lamps do not coincide and the overall light output, which is the average of the light outputs of the different LEDs, will show no flicker. Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
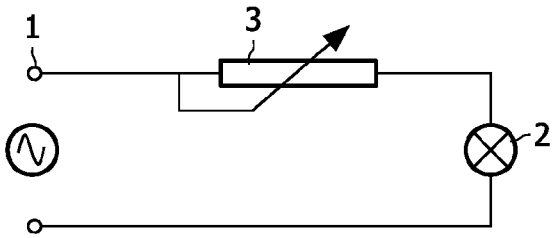
FIG. 1 is a block diagram schematically illustrating a traditional approach for dimming a light source.
Figure 2:
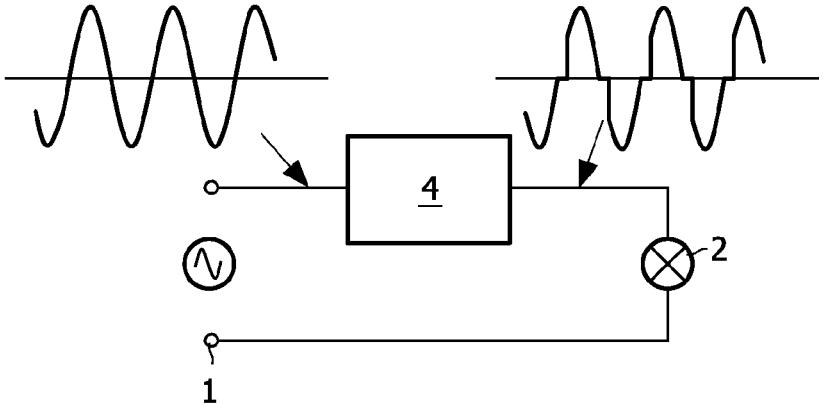
FIG. 2 is a block diagram schematically illustrating a different but nevertheless traditional approach for dimming a light source.
Figure 3:
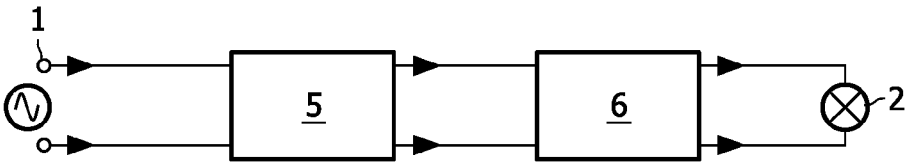
FIG. 3 is a block diagram schematically illustrating "duty cycle dimming at higher frequency"
Figure 4:
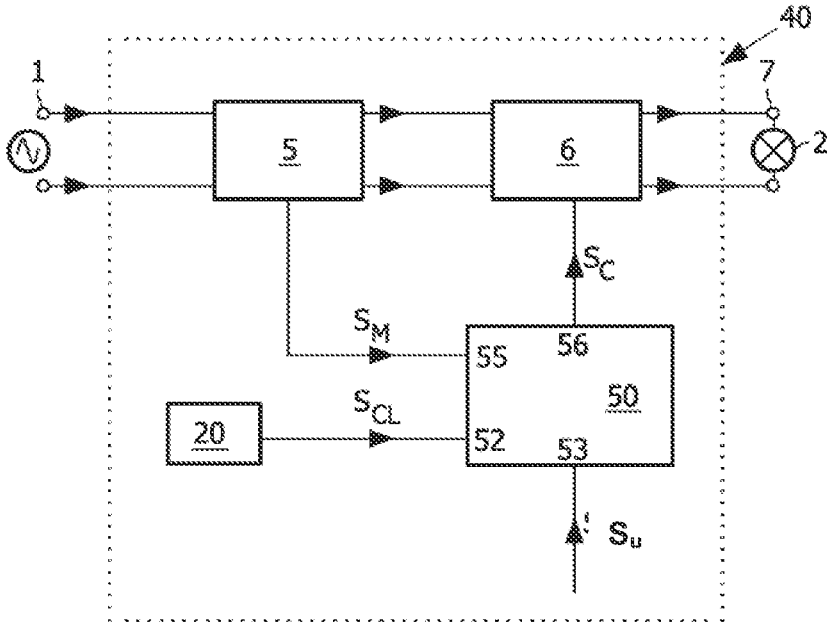
FIG. 4 is a block diagram schematically illustrating an embodiment of a LED driver according to the present invention.

FIG. 4 is a block diagram schematically illustrating an embodiment of a LED driver 40 according to the present invention. The general design of this driver corresponds to a great extent to the design of FIG. 3; a lamp output is indicated at 7. The driver 40 further comprises a controller 50 for controlling the chopper 6 and a clock generator 20 for generating a clock signal $S_{CL}$. The controller 50 has a clock input 52 coupled to an output of the clock generator 20 for receiving the clock signal $S_{CL}$ from the clock generator 20. The controller 50 has a user input 53 for receiving a user input signal $S_U$ indicating a desired dimming level, the user input signal for instance being generated by a potentiometer (not shown). The controller 50 has a mains input 55 coupled to the ACDC converter (or, alternatively, to the input 1 directly) for receiving a mains signal $S_M$ representing the actual phase of the mains voltage at input 1; such mains signal may be derived from the input mains voltage or any intermediate voltage by any suitable means, for instance a voltage sensor, as will be clear to a person skilled in the art and requiring no further explanation. The controller 50 has a controller output 56 coupled to the chopper 6.

At its control output 56, the controller 50 generates a control signal Sc for the chopper 6, the control signal Sc determining the switching moments when the current from the ACDC converter 5 is blocked and the switching moments when the current from the ACDC converter 5 is allowed to pass. Particularly, the control signal $S_C$ determines the chopping frequency and the chopping period, and determines the chopping duty cycle.

The controller 50 is designed to calculate the required duty cycle on the basis of the user input signal $S_U$.

Further, the controller 50 is designed to calculate the chopping frequency at an arbitrary suitable value within a predetermined frequency range, for instance from 300 Hz to 3000 Hz, or at a fixed frequency predetermined by the manufacturer.

According to an important feature of the present invention, the controller 50 is designed to have the control signal $S_C$ (or, in any case, the resulting chopped output current) be synchronized with the mains voltage at input 1, on the basis of the mains signal $S_M$. Methods for synchronizing the output control signal $S_C$ with the input mains signal $S_M$ are available and clear to a person skilled in the art, and include for instance a phase-locked loop; a further explanation is not required here.

On synchronizing the output control signal $S_C$ with the input mains signal $S_M$, the controller 50 has a freedom as regards the phase difference of the output control signal $S_C$ (cq the resulting chopped output current) with respect to the input mains signal $S_M$. This phase difference can for instance be expressed as the phase of the output control signal $S_C$ (cq the resulting chopped output current) at a downwards zero-crossing of the input mains signal $S_M$, as should be clear to a person skilled in the art.

If said phase difference would be a predetermined fixed value, equal to all drivers, then the result would be that, in a system 100 having multiple LEDs with different drivers, all LEDs would be switched ON and/or OFF at exactly the same moment, so any flicker effect would be intensified and more noticeable. Therefore, in such system, it would be advantageous if the output control signals of the different drivers have mutually different phases. One solution would be to provide a set of drivers 40A, 40B, 40C etc adapted to each other so that they have mutually different phases; for instance, in a system comprising 12 drivers, the mutual phase differences can always be 30° or an integer multiple thereof.

Figure 5:
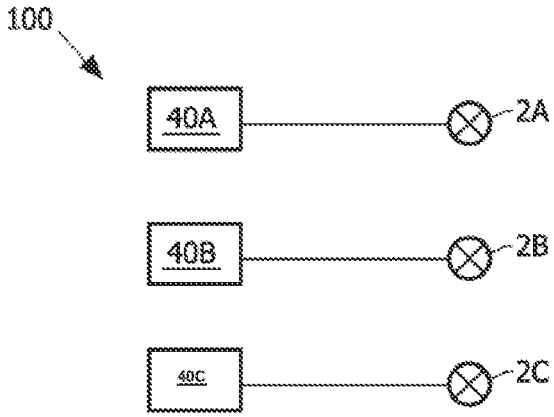
FIG. 5 is a block diagram schematically illustrating a system comprising multiple LEDs with associated drivers.

However, a solution that offers more flexibility and that is therefore preferred does not require adapting drivers to each other. In this preferred embodiment, the controller 50 is always designed to set the phase difference of the output control signal $S_C$ (cq the resulting chopped output current) with respect to the input mains signal $S_M$ at a random value between 0 and 360°. Then, in a system 100 having multiple LEDs 2A, 2B, 2C with different drivers 40A, 40B, 40C (see FIG. 5), the result would be that in practice the chances are high that different drivers 40A, 40B, 40C would have different phases and the dark periods of the different lamps would not coincide so that any flicker would be hardly or not noticeable any more.

It is noted that methods for determining a random phase difference for the output control signal $S_C$ will be known to a person skilled in the art and require no further explanation.

It is further noted that the random phase difference does not have to be perfectly constant in time. If this phase difference changes slowly over time, i.e. on a time scale much larger than the mains period, such would be hardly or not noticeable to the human eye. Further, assuming that such changes themselves are mutually independent and do not result in the different output control signals $S_C$ becoming synchronized, the result would still be that the dark periods of the different light outputs would not coincide and the overall light output, which is the average of the light outputs of the different LEDs, would show hardly or no flicker.

It is further noted that it is preferred that the chopping frequency is the same for all drivers, but this is not essential.

Summarizing, the present invention provides a driver 10 for driving a LED 2, which driver comprises:

- an ACDC converter 5 receiving AC mains voltage and generating DC output current;
- a chopper 6 receiving the DC output current and provide a regularly interrupted output current;
- a clock generator 20 generating a clock signal $S_{CL}$;
- a controller 50 receiving a user input signal $S_U$ indicating a dimming level, receiving the clock signal, receiving a mains signal $S_M$ representing the actual phase of the mains voltage, and generating a control signal $S_C$ for the chopper.

The chopper is responsive to the controller's control signal as regards the switching moments of the output current.

The controller calculates the required duty cycle on the basis of the user input signal.

The controller synchronizes its control signal with the mains signal.

The controller sets an arbitrary value for the phase difference of the output control signal with respect to the input mains signal.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims. For instance, it is possible that the chopper 6 and the converter 5 are integrated into one unit, and it is possible that the chopping effect is obtained by regularly switching the converter 5 ON and OFF.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Illumination system comprising a plurality of LEDs with associated driver, each driver comprising:

- a power input for receiving AC mains voltage;
- an AC to DC converter for receiving the AC mains voltage and outputting a DC mains voltage;
- a chopper for receiving the DC mains voltage and for outputting a regularly interrupted output current having a current interruption frequency and a variable duty cycle, and having an input to receive to a control signal;
- a lamp output, receiving the regularly interrupted output current, for connecting to a light source;
- a clock generator for generating a clock signal;
- a controller having a user input for receiving a user input signal indicating a desired dimming level, having a clock input coupled for receiving the clock signal from the clock generator, having a mains input coupled for receiving a mains signal representing the actual phase of the mains voltage at the power input, and having a control output for generating a control signal for the current source means;

wherein the controller is designed to synchronize its control signal with the mains signal received at its mains input, wherein each controller and is configured to set an arbitrary value for the phase difference of its output control signal with respect to the input mains signal, wherein the chopper sets the current interruption frequency and the variable duty cycle according to the control signal received at the control signal input.

2. The illumination system according to claim 1, wherein the controller is configured to calculate the current interruption frequency at an arbitrary suitable value within a predetermined frequency range.

3. The illumination system of claim 2, wherein the predetermined frequency range is from 300 Hz to 3000 Hz.

4. The illumination system of claim 1, wherein the controller is configured to calculate the current interruption frequency at a fixed predetermined frequency.

5. The illumination system of claim 1, wherein each controller associated with each driver is configured to set, independently and randomly, an associated fixed value for the phase difference of its output control signal with respect to the input mains signal, such that two or more of the controllers of the different drivers of the illumination system generate output control signal with different phase differences with respect to the mains signal.

6. The illumination system of claim 1, wherein the lamp output is connected to one or more LEDs of the plurality of LEDs.

7. The illumination system of claim 1, wherein the controller is configured to calculated the duty cycle based on the user input signal.

* * * * *